United States Patent [19]

Shaw et al.

[11] Patent Number: 4,718,873

[45] Date of Patent: Jan. 12, 1988

[54] LOCK FOR WATER SKI BINDING

[75] Inventors: Charles L. Shaw, Kirkland; Ray Elder, Seattle; Douglas A. Barchek, Issaquah, all of Wash.

[73] Assignee: O'Brien International, Inc., Redmond, Wash.

[21] Appl. No.: 771,214

[22] Filed: Aug. 30, 1985

[51] Int. Cl.[4] ..... A63C 15/06

[52] U.S. Cl. ..... 441/70

[58] Field of Search ..... 441/70; 280/11.31–11.34, 611, 616, 618, 623, 625, 627, 629–635; 292/257

[56] References Cited

U.S. PATENT DOCUMENTS

| | | | |
|---|---|---|---|
| 2,508,597 | 5/1950 | Dalrymple | 292/257 |
| 3,010,125 | 11/1961 | Hedlund | 441/70 |
| 3,992,738 | 11/1976 | Kiefer | 441/70 |
| 4,040,137 | 8/1977 | Fetherston et al. | 441/70 |
| 4,494,939 | 1/1985 | Calapp et al. | 280/623 |

*Primary Examiner*—Joseph F. Peters, Jr.
*Assistant Examiner*—Jesûs D. Sotelo

[57] ABSTRACT

A lock for a water ski binding includes upper and lower parts which are mounted on a stud which extends upwardly from the ski through a slot in the heel cup of the binding. The two lock parts have interengaging camming surfaces, and when the top part is rotated about the stud from an unlocked position to a locking position, the bottom part is forced downwardly to clamp the heel cup against the ski.

8 Claims, 23 Drawing Figures

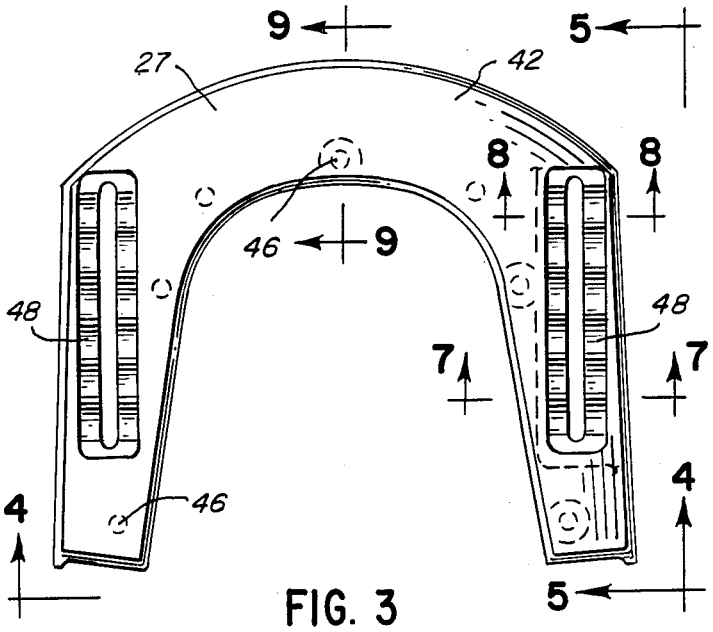
FIG. 3
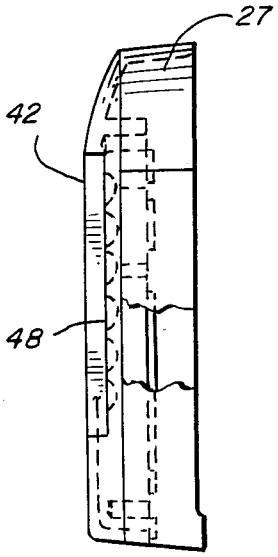
FIG. 5
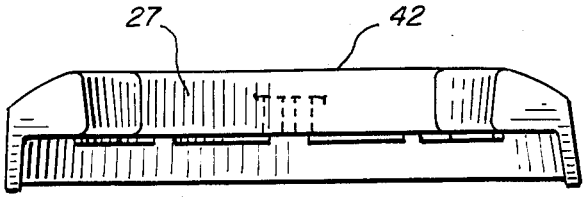
FIG. 4
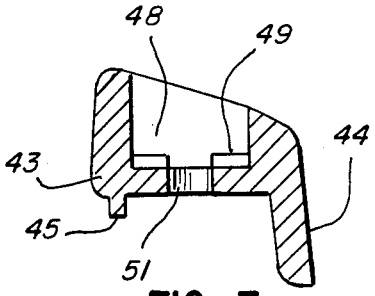
FIG. 7
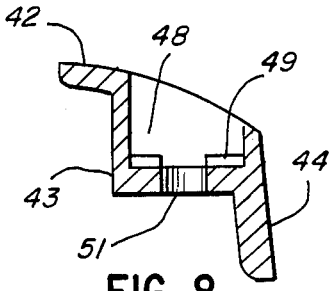
FIG. 8
FIG. 6
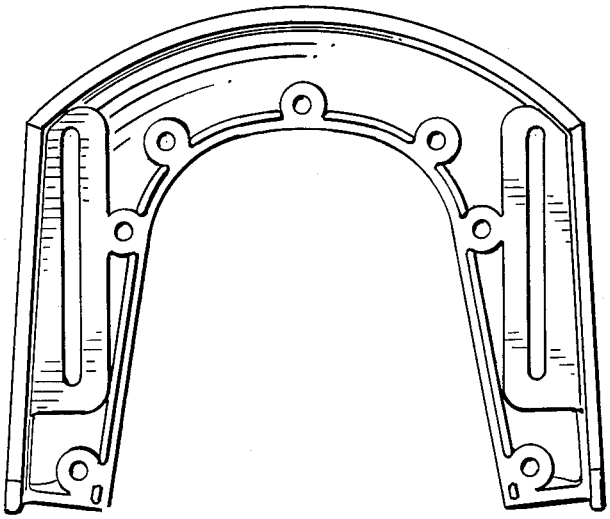
FIG. 9
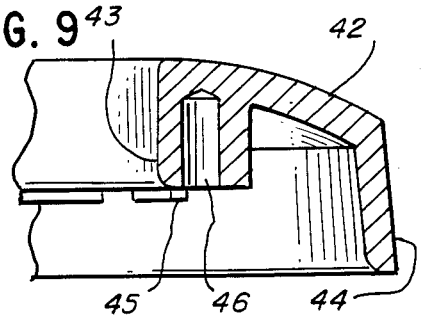

FIG. 10
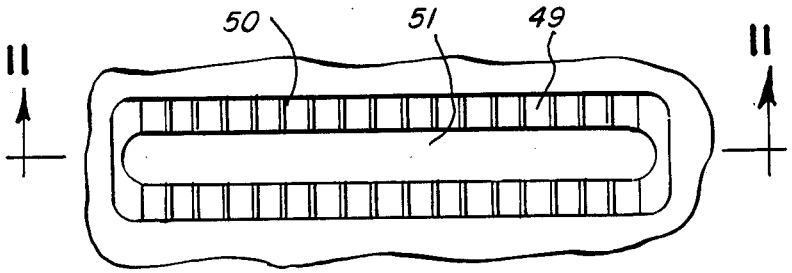
FIG. 11
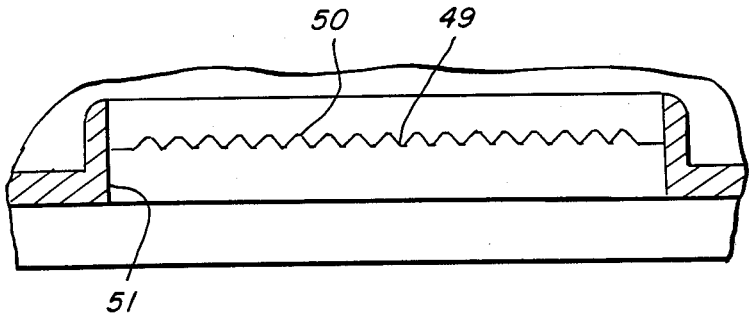
FIG. 12
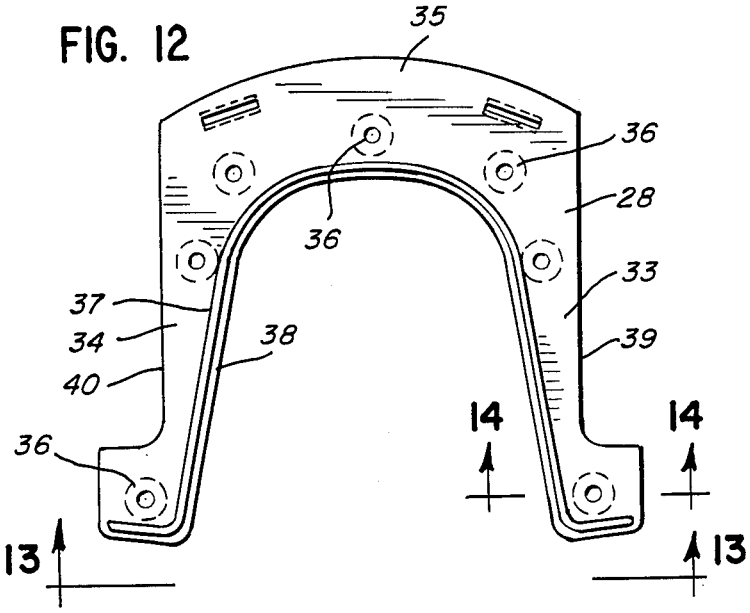
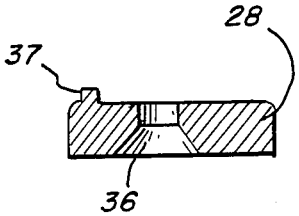
FIG. 14
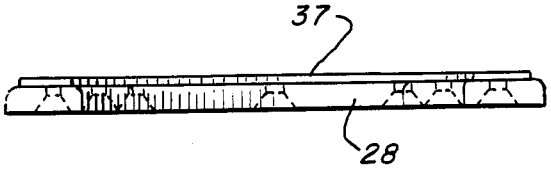
FIG. 13

LOCK FOR WATER SKI BINDING

BACKGROUND AND SUMMARY

This invention relates to bindings for water skis, and, more particularly, to a device for locking a water ski binding in a desired position.

The invention is an improvement over the cam latch which is described in U.S. Pat. No. 4,494,939. As described in that patent, water ski bindings commonly include wing nuts for clamping the heel cup of the binding against the ski so that the heel cup is maintained in the desired position. The wing nuts are threadedly engaged with studs which extend upwardly from the ski through slots in the heel cup.

U.S. Pat. No. 4,494,939 describes a cam latch which is used in place of the wing nuts. The cam latch is pivotally secured to the stud for pivoting about an axis which extends perpendicularly to the stud. The bottom of the cam latch is elliptically shaped and eccentrically mounted with respect to the pivot axis. The elliptical portion of the cam engages one of a plurality of arcuate detents in the heel cup, and as the cam latch is rotated over center, the cam forces the detent and the heel cup forwardly. The forward movement of the heel cup can cause discomfort to the foot of the skier. Also, the device cannot easily be adjusted to compensate for wear.

The invention provides a two-part locking device which provides a downward clamping force on the heel cup and which can be moved quickly and easily from a locking position to an unlocked position by rotating one of the parts less than one-half of a turn. The stud extends through both parts of the lock, and the lower part of the lock rides on the heel cup and engages the slot in the heel cup so that it cannot rotate relative to the heel cup. The upper part of the lock is positioned between the lower part and the head of the stud. Both lock parts are provided with camming ramps which are engageable with each other, each camming ramp extending spirally around the stud for about 180°. The bottom surface of the bottom part is serrated or roughened and engages a similarly serrated or roughened surface on the heel cup. When the upper part is rotated about the axis of the stud, the camming ramps force the bottom part downwardly to clamp the heel cup against the ski. The lock can be moved between the unlocked and locking positions merely by rotating the upper part of the lock less than one half of a turn, and the locking force is exerted downwardly on the heel cup rather than downwardly and forwardly. As a result, the heel cup is not moved forwardly from the position which is initially selected. The interengaged serrated surfaces of the bottom part of the lock and the heel cup decrease the possibility that the heel cup will slide relative to the ski and provide finer increments between adjacent locking positions than do any of the prior art devices previously referred to. Further, the clamping force can be adjusted and fine tuned merely by rotating the stud.

DESCRIPTION OF THE DRAWING

The invention will be explained in conjunction with an illustrative embodiment shown in the accompanying drawings, in which—

FIG. 3 is a top plan view of the top plate of the heel cup of the ski binding;

FIG. 4 is a front elevational view of the top plate taken along the line 4—4 of FIG. 3;

FIG. 5 is a side elevational view of the top plate of the heel cup taken along the line 5—5 of FIG. 3;

FIG. 6 is a bottom plan view of the top plate of the heel cup;

FIG. 7 is a fragmentary sectional view taken along the line 7—7 of FIG. 3;

FIG. 8 is a fragmentary sectional view taken along the line 8—8 of FIG. 3;

FIG. 9 is a fragmentary sectional view taken along the line 9—9 of FIG. 3;

FIG. 10 is an enlarged fragmentary top plan view of one of the longitudinal slots in the top plate;

FIG. 11 is a sectional view taken along the line 11—11 of FIG. 10;

FIG. 12 is a top plan view of the bottom plate of the heel cup;

FIG. 13 is a front elevational view of the bottom plate taken along the line 13—13 of FIG. 12;

FIG. 14 is an enlarged sectional view taken along the line 14—14 of FIG. 12;

DESCRIPTION OF SPECIFIC EMBODIMENT

Figure 1:
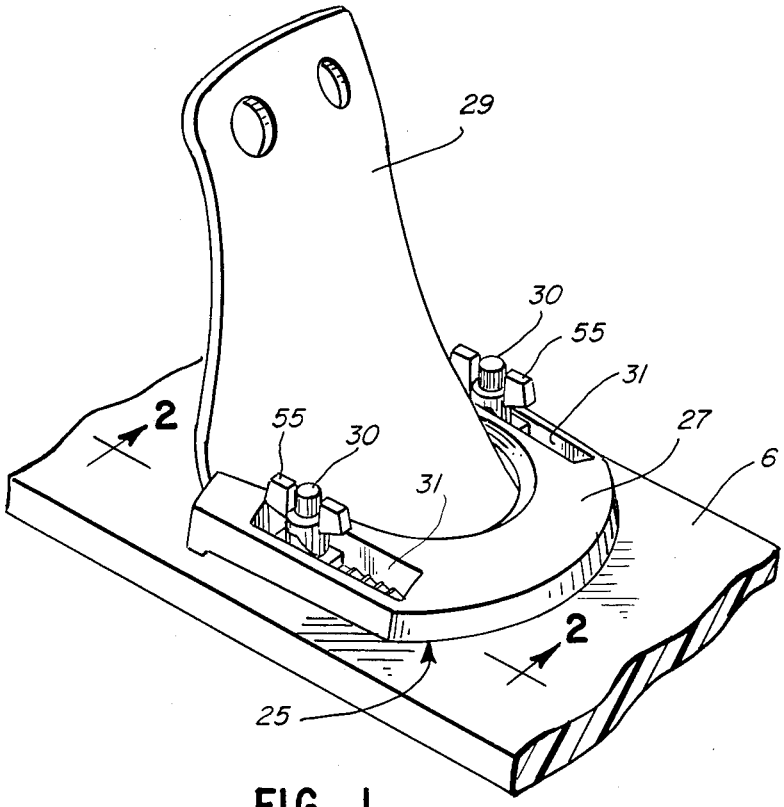
FIG. 1 is a fragmentary perspective view of the heel portion of a water ski binding equipped with a lock formed in accordance with the invention.

Referring first to FIG. 1, a heel cup assembly 25 is adjustably mounted on a water ski 26. The heel cup cooperates with a conventional footpiece (not shown) which is mounted on the ski forwardly of the heel cup. The heel cup assembly may also be conventional, and the area of novelty lies in the particular locking device which is used to clamp the heel cup in the desired position.

The heel cup assembly 21 includes a U-shaped top plate 27, a U-shaped bottom plate 28 (FIG. 12), and a rubber boot 29 which is clamped between the base plate and the top plate. The heel cup assembly is adjustably secured to the ski by a pair of studs 30 which are anchored to the ski and which extend upwardly through longitudinal slots 31 in the top plate 27.

Referring to FIG. 12, the base plate 28 includes a pair of side portions 33 and 34 and a heel portion 35. A plurality of screw holes 36 are provided in the base plate for securing the base plate to the top plate, and a rib 37 extends upwardly adjacent the inner edge 38 of the base plate. The outer side edges 39 and 40 of the base plate are spaced apart a distance less than the distance between the studs 30.

As can be seen in FIGS. 3–9, the top plate 27 includes an upper wall 42 and downwardly extending inner and outer walls 43 and 44. A rib 45 extends downwardly from the inner wall 43 in alignment with the rib 37 on the lower plate, and a plurality of screw holes 46 are provided in the top plate in alignment with the screw holes 36 in the bottom plate. An elongated recess 48 is provided in each side of the top plate, and the upper surface 49 (see also FIGS. 10 and 11) is serrated, i.e., is provided with a plurality of sawtooth or triangular projections 50. A longitudinally extending slot 51 extends through each of the recess portions of the top plate, and the studs 30 on the ski extend through the slots.

The heel cup 25 is assembled by inserting the lower edge of the rubber boot 29 between the top and bottom plates 27 and 28 and clamping the plates together by screws which are inserted through the screw holes 36 in the bottom plate and screwed into the screw holes 46 in the top plate.

Figure 2:
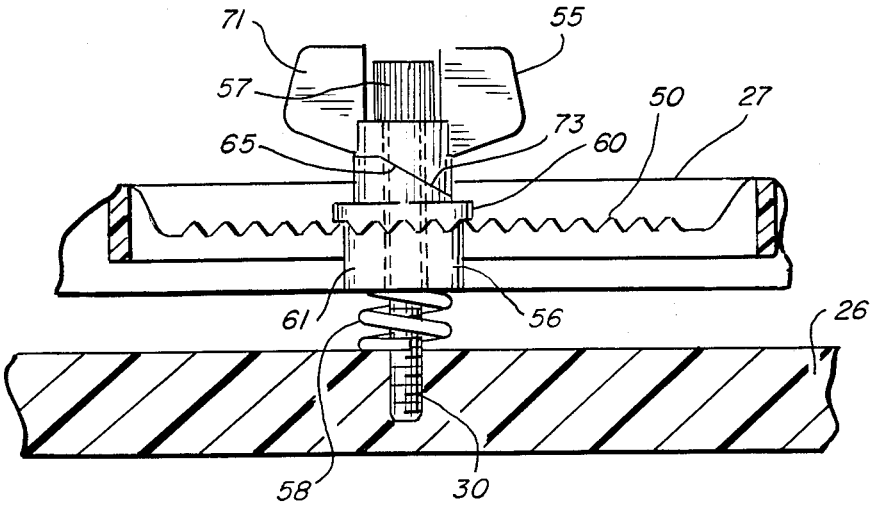
FIG. 2 is an enlarged fragmentary sectional view taken along the line 2—2 of FIG. 1.
Figure 18:
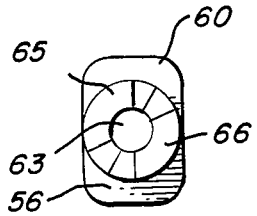
FIG. 18 is a top plan view taken along the line 18—18 of FIG. 16.
Figure 19:
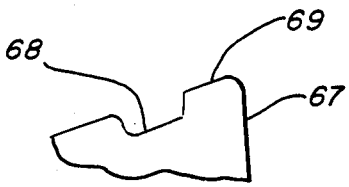
FIG. 19 is an enlarged fragmentary view of the locking notch on the camming ramp of the bottom part.
Figure 16:
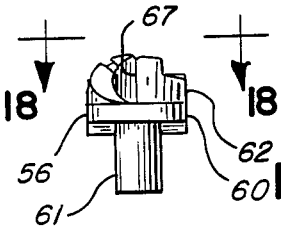
FIG. 16 is an elevational view taken along the line 16—16 of FIG. 15.
Figure 15:
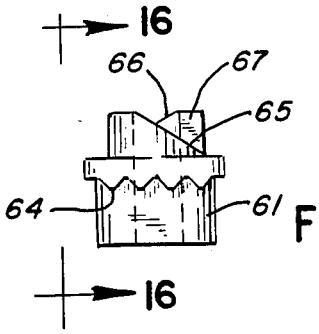
FIG. 15 is a side elevational view of the bottom part of the lock.
Figure 17:
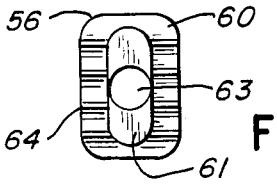
FIG. 17 is a bottom plan view taken along the line 17—17 of FIG. 16.
Figure 23:
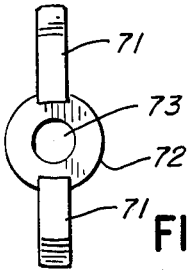
FIG. 23 is a top plan view taken along the line 23—23 of FIG. 21.
Figure 21:
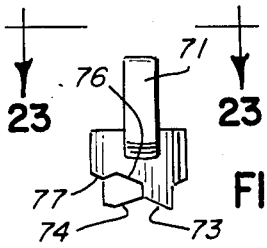
FIG. 21 is a elevational view taken along the line 21—21 of FIG. 20.
Figure 22:
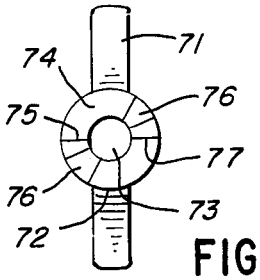
FIG. 22 is a bottom plan view taken along the line 22—22 of FIG. 21.
Figure 20:
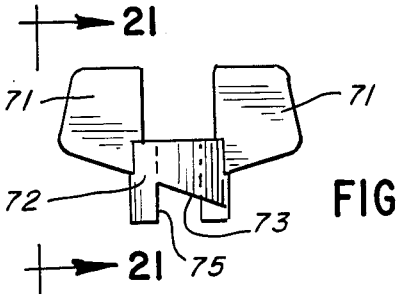
FIG. 20 is a side elevational view of the top part of the lock.

Referring to FIG. 2, a two part lock assembly 54 is mounted on each of the studs 30 and includes a top part 55 and a bottom part 56. The lower end of the stud is screwed into the ski, and the upper end includes a head 57. The lock assembly is biased upwardly against the head 57 by a coil spring 58 which surrounds the stud between the ski and the bottom part 56. The stud head is provided with an Allen wrench recess, and the stud can be rotated to move the lock assembly closer to or farther away from the ski to fine tune the locking force and to compensate for wear.

The bottom part 56 is illustrated in FIGS. 15–19 and includes a rectangular base 60, a downwardly extending slide portion 61, and an upwardly extending cylindrical cam portion 62. A stud hole 63 extends through the center of the part. The slide portion 61 extends into the longitudnal slot 51 of the top plate 27 and prevents the bottom part from rotating with respect to the top plate. The bottom surface of the base 60 is serrated and includes sawtooth projections 64 similar to the projections 50 in the recess of the top plate.

The camming portion 62 of the bottom part includes a pair of camming ramps 65 and 66 which extend upwardly from the base portion 60 and which extend spirally around the center stud hole 63 for about 180°. Each ramp terminates in a vertical wall 67 (see also FIG. 19) and is provided with a locking recess 68 and a locking projection 69 adjacent the vertical wall.

The top part 55 of the lock is illustrated in FIGS. 20–23 and includes a cylindrical base portion 70 and a pair of outwardly extending wings 71. A stud hole 72 extends through the center of the top part. A pair of camming ramps 73 and 74 on the bottom of the base extend spirally around the stud hole and are designed to mate with the camming ramps 65 and 66 on the bottom part 56. Each ramp terminates in a vertical wall 75 and is provided with a locking recess 76 and a locking projection 77 adjacent the vertical wall.

FIG. 2 illustrates the lock assembly in an unlocked position. The camming ramps 65 and 66 on the bottom portion engage the camming ramps 73 and 74, respectively, on the top part along the entire length of the ramps, and the vertical walls 67 and 75 abut each other. The lock assembly is moved to a locking position by rotating the top part 55 clockwise. As the camming ramps 73 and 74 on the top part rotate relative to the camming ramps 65 and 66, the bottom part 56 is forced downwardly. The serrated bottom surface 64 in the bottom part engages the serrated top surface 50 of the recess in the top plate 27, and the outer side wall of the top plate is thereby clamped against the ski.

After the top part rotates about 135°, the locking projections 69 on the camming ramps of the bottom part project into the locking recesses 76 in the camming ramps of the top part, and the locking projections 77 on the top part project into the locking recesses 68 on the bottom part. The two locking parts are thereby maintained in the locking position, and the heel cup assembly is maintained in clamping engagement with the ski. The serrated bottom surface 64 on the bottom part engages the serrated surface 50 of the top plate, thereby restraining sliding movement of the top plate relative to the bottom part of the lock.

The corners of the locking recesses 68 and 76 and the locking projections 69 and 77 of the camming ramps are rounded, and the locking projections can be cammed out of the locking recesses by exerting a counterclockwise rotating force on the top part of the lock. As the camming ramps of the top part rotate counterclockwise relative to the camming ramps of the bottom part, the bottom part is moved upwardly by the force of the coil spring 58, and the clamping force on the heel cup is relieved. The position of the heel cup can then be changed by sliding the heel cup longitudinally relative to the ski.

It will be appreciated from the foregoing that the heel cup can be quickly and easily locked in the desired position merely by rotating the top part of the lock less than one-half of a turn. The camming ramps of the two parts of the lock provide a mechanical advantage which provides substantial downward movement of the bottom part of the lock with relatively little rotation of the top part, and sufficient clamping force is exerted on the heel cup to maintain the heel cup in the desired position during normal use. The interengaging serrated projections on the bottom part of the lock and the heel cup are spaced-apart relatively short distances, and little or no longitudinal movement of the heel cup is caused by downward movement of the bottom part of the lock. The heel cup will therefore not be moved out of the selected position, and excessive force will not be exerted against the foot of the skier. If the lock parts wear, the clamping force can easily be adjusted simply by rotating the stud to screw the head of the stud downwardly, thereby moving the lock parts downwardly.

While in the foregoing specification a detailed description of a specific embodiment of the invention was set forth for the purpose of illustration, it will be understood that many of the details herein given may be varied considerably by those skilled in the art without departing from the spirit and scope of the invention.

We claim:

1. A lock assembly for a water ski having a binding assembly including a heel cup provided with an elongated slot, a stud extending upwardly from the ski through the slot in the heel cup for slidably mounting the heel cup relative to the ski, and a serrated surface on said heel cup, the lock assembly including a bottom part mounted on the stud, means on the bottom part engageable with the heel cup for preventing rotation of the bottom part relative to the heel cup, the bottom part including a serrated surface which is engageable with the serrated surface of the heel cup, a top part rotatably mounted on the stud above the bottom part, means on the stud for retaining the top part on the stud, each of the bottom part and the top part having inter-engaging camming surfaces whereby the bottom part may be forced downwardly against the heel cup by rotating the top part about the stud.

2. The lock assembly of claim 1 in which the camming surface of each of the bottom part and the top part is provided by a pair of camming ramps which extend spirally around the stud.

3. The lock assembly of claim 2 including lock means on at least one of the camming ramps for releasably locking the top part in a locked position.

4. The lock assembly of claim 3 in which the lock means includes a projection on one of the camming ramps which is engageable with a recess on another of the camming ramps.

5. The lock assembly of claim 2 in which each of the camming ramps extends for about 180°.

6. The locking assembly of claim 2 in which each of the camming ramps terminates in a vertical wall.

7. The lock assembly of claim 1 in which the means for preventing rotation of the bottom part includes a downwardly extending projection on the bottom part which extends into the slot.

8. The locking assembly of claim 1 in which the stud is threadedly engaged with the stud and includes means for rotating the stud whereby the distance between the lock assembly and the ski can be adjusted.

* * * * *